US007317808B2

(12) United States Patent
Niehoff

(10) Patent No.: US 7,317,808 B2
(45) Date of Patent: Jan. 8, 2008

(54) MICROPHONE

(75) Inventor: Wolfgang Niehoff, Wedemark (DE)

(73) Assignee: Sennheiser Electronic GmbH & Co., KG, Wedemark (DE)

( * ) Notice: Subject to any disclaimer, the term of this patent is extended or adjusted under 35 U.S.C. 154(b) by 86 days.

(21) Appl. No.: 10/623,204

(22) Filed: Jul. 18, 2003

(65) Prior Publication Data

US 2004/0071302 A1 Apr. 15, 2004

(30) Foreign Application Priority Data

Jul. 24, 2002 (DE) ..... 102 33 456

(51) Int. Cl.
*H04R 9/08* (2006.01)

(52) U.S. Cl. ..... 381/355; 381/361

(58) Field of Classification Search ..... 381/172, 381/355, 361; 40/433; 379/430
See application file for complete search history.

(56) References Cited

U.S. PATENT DOCUMENTS 4,239,356 A * 12/1980 Freudenschuss et al. ..... 396/59
5,406,729 A * 4/1995 Bejin ..... 40/433
6,690,804 B2 * 2/2004 Everett ..... 381/122
2002/0021800 A1 * 2/2002 Bodley et al. ..... 379/430

FOREIGN PATENT DOCUMENTS

| | | |
|---|---|---|
| EP | 22 06 996 | 8/1973 |
| EP | 00 62 164 | 10/1982 |
| EP | 196 51 463 | 4/1998 |
| JP | 2001-289675 | * 10/2001 |

* cited by examiner

*Primary Examiner*—Brian Ensey
(74) *Attorney, Agent, or Firm*—Reed Smith LLP

(57) ABSTRACT

The invention is directed to a microphone, particularly a microphone of the kind used in theaters or in television studios, preferably a wireless microphone. It is known to provide marking in the form of a microphone cap or a colored adhesive tape at the end of the microphone for the variously assigned individual microphones in the studios. These solutions are relatively cumbersome and are seldom very attractive in appearance. The object of the invention is to avoid the previous disadvantages by providing a microphone with a color display which is visible from the outside and which signals the ready status of the microphone, wherein a switching device is provided for switching the color of the display.

6 Claims, 2 Drawing Sheets

MICROPHONE

CROSS-REFERENCE TO RELATED APPLICATION

This application claims priority of German Application No. 102 33 456.0, filed Jul. 24, 2002, the complete disclosure of which is hereby incorporated by reference.

BACKGROUND OF THE INVENTION a) Field of the Invention

The invention is directed to a microphone, particularly a microphone of the kind used in theaters or in television studios, preferably a wireless microphone.

b) Description of the Related Art

Sound technicians working in television studios always want to know whether or not the artist, moderator or guest in question is holding the microphone intended for them and whether or not that microphone is ready to operate. The ready status of wireless microphones can also be determined by regular technical means. However, it is also desirable to determine readiness to operate simply by glancing at the microphone without expending a great deal of effort on tests.

Therefore, it has already been suggested to outfit microphones of this type with a ready-status LED at the end of the microphone. As long as this LED is lit, the studio sound technician knows that the microphone is working properly.

It is also known to provide marking in the form of a microphone cap or a colored adhesive tape at the end of the microphone for the variously assigned individual microphones in the studios. These solutions are relatively cumbersome and are seldom very attractive in appearance.

OBJECT AND SUMMARY OF THE INVENTION

The primary object of the invention is to avoid the previous disadvantages.

According to the invention, this object is met by a microphone with a color display and which signals the ready status of the microphone. A switching device is provided for switching the color of the display.

DETAILED DESCRIPTION OF THE DRAWINGS

Figure 1:
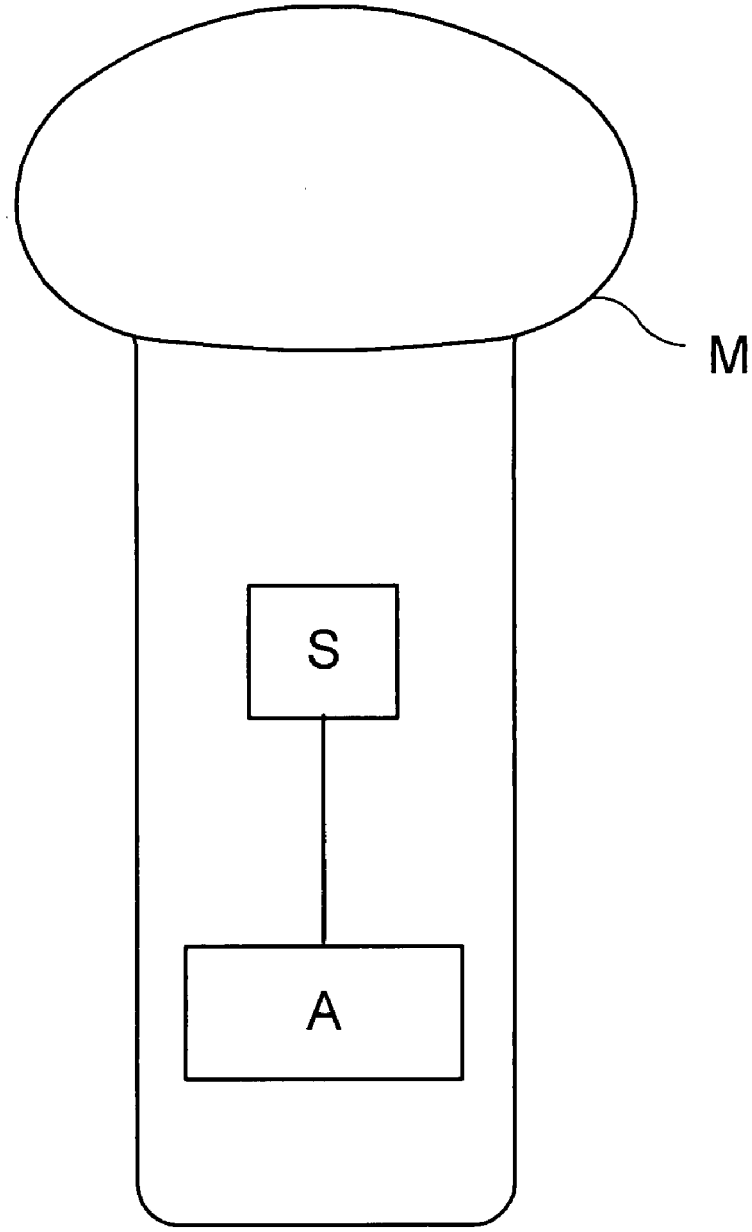
FIG. 1 shows a schematic illustration of a microphone M.

FIG. 1 illustrates a microphone M comprising, among others, a color display A which is coupled to a switching device S.

Figure 2:
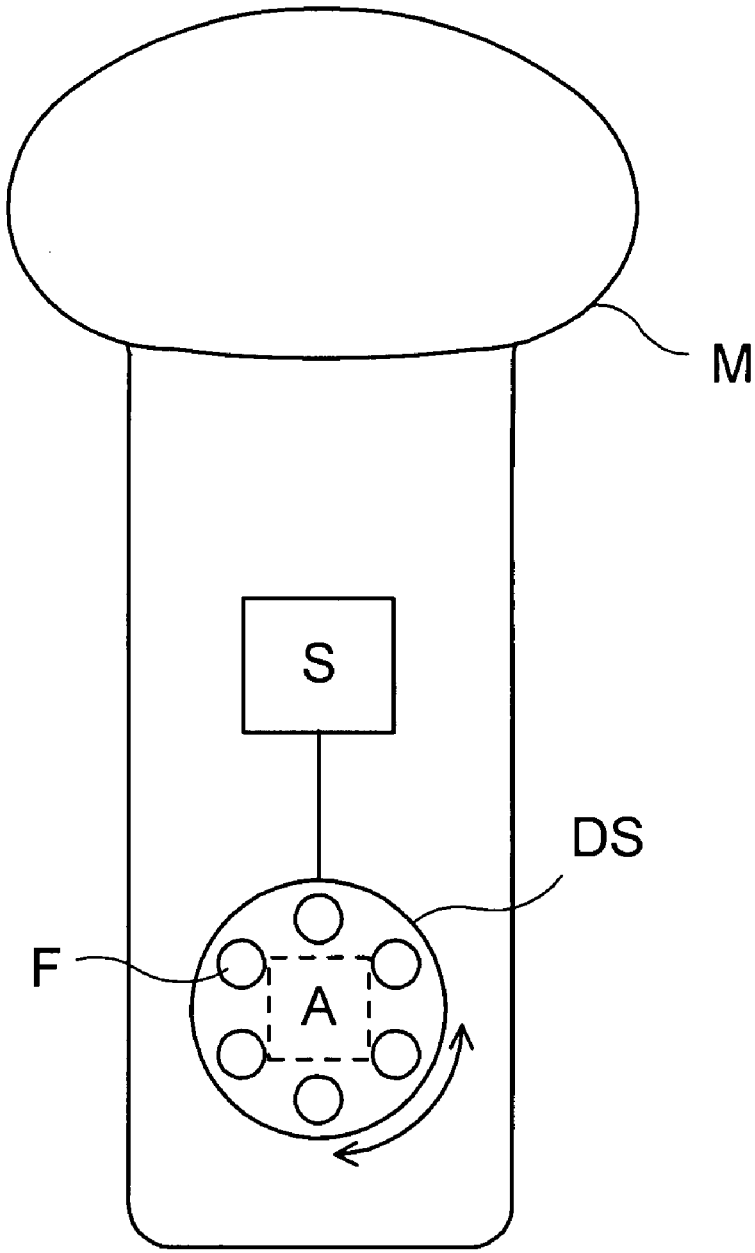
FIG. 2 shows a more detailed schematic illustration of a microphone M.

FIG. 2 illustrates a microphone M having a color display A which is connected to a switching device S. A rotatable disc DS with windows F of different colors is also provided.

With the microphone according to the invention it is not only possible to determine already from the outside of the microphone whether or not the microphone is ready to operate and is switched on, but it is also possible to differentiate between the microphones within the studio by the lighting up of a determined color marking which distinguishes this microphone from other microphones with other color markings.

Color markings of the microscope can be converted technically in such a way that, for example, a multicolored LED is built into the microphone and the color assignment for a microphone intended for a specific use is carried out by means of a switching device, so that the microphone always lights up in a color such as blue, red, yellow, green or a corresponding easily recognizable mixed color when switched on. Accordingly, this microphone can always be correctly identified (e.g., blue microphone) in the studio in a simple manner and the studio worker also always knows while the microphone is in use whether the artist, studio guest, moderator, etc. has the microphone intended for him or her, and it can also be determined at the same time whether or not the microphone is really switched on and ready to operate.

In another, alternative solution, a white LED can also be built into the microphone and covered by a rotatable disk in which windows of different colors are formed, so that the corresponding outwardly visible light color can be adjusted by moving the rotatable disk.

The actual adjustments are always made inside the studio and not by the microphone user, for instance. Care must be taken that the respective settings are not accidentally changed. For this reason, the switching devices for adjusting the respective light color can also be constructed so as to be hidden, e.g., under the cap which can be detached from the microphone in order to switch and/or adjust the desired light color. In this case, of course, the housing of the microphone or the cap should have a corresponding window through which the colored point of light can be discerned even from a distance of several meters.

The illumination, particularly the LED illumination, can possibly be coupled with an information transmitter inside the microphone and its light can be pulsed by a pulse transmitter in such a way that encoded information (e.g., "microphone no. 1" or "battery power down 20%" or "microphone with identification sign A, B, C, . . . ", etc.) is accordingly transmitted. In this case, it may well be that the maximum pulse width is in the range of several seconds or a few milliseconds or microseconds. When the studio camera is adjusted to the evaluation of the pulsed light signals, the information can also be evaluated automatically by the TV camera by means of the pulsed light of the microphone and conveyed to the studio manager.

The pulsed light of the microphone containing information can also be detected and evaluated by any other light detector instead of the TV camera.

It goes without saying that as regards the transmission of information and, insofar as the present application has to do with light, this light can also be infrared light or another light signal that is invisible to the human eye. It is also possible for the transmission of information to be carried out by alternating the colored light. For example, an agreed upon assignment of information can be conveyed by different colored lights (e.g., red once, blue once, yellow once, green twice, red once means microphone battery power down 50%).

Of course, the encoding of information can also be carried out by means of pulse length coding or pulse width coding of the light.

While the foregoing description and drawings represent the present invention, it will be obvious to those skilled in the art that various changes may be made therein without departing from the true spirit and scope of the present invention.

What is claimed is:

1. An arrangement of a plurality of wireless microphones comprising:

a color display positioned in the wireless microphone which is visible from the outside and which signals a ready status of the microphone; and a switching device positioned in the wireless microphone being provided for switching the color of the display, wherein the wireless microphone is differentiated between other microphones of the arrangement within an area by illuminating a color marking which distinguishes the microphone from other microphones having different color markings.

2. The microphone according to claim 1, wherein the microphone has multicolored LED elements, wherein the LED lights can be controlled by said switching device in such a way that only a desired color is visible from the outside.

3. The microphone according to claim 1, wherein illumination which emits white light is provided in the microphone, wherein the illumination is covered by a rotatable disk in which windows of different colors are formed.

4. The microphone according to claim 2, wherein LED illumination is pulsed and information can be transmitted by way of the illumination and evaluated automatically by a studio TV camera system.

5. The microphone according to claim 3, wherein the LED illumination is pulsed and information can be transmitted by way of the illumination and evaluated automatically by a studio TV camera system.

6. A wireless microphone system comprising:

an arrangement of a plurality of wireless microphones;

wherein each one of the plurality of wireless microphones comprises:

a color display which is visible from the outside and which signals one of a plurality of parameters of the wireless microphone; and a switching device positioned inside each one of the plurality of wireless microphones being provided for switching the color of the display depending on a specific parameter assigned to the wireless microphone, wherein each one of the plurality of wireless microphones is differentiated between other wireless microphones of the arrangement within an area by illuminating a color marking which distinguishes each one of the plurality of wireless microphones from other wireless microphones having different color markings.

* * * * *